US006873811B2

(12) United States Patent
Huffman et al.

(10) Patent No.: US 6,873,811 B2
(45) Date of Patent: Mar. 29, 2005

(54) PRINTER IMAGING COMPONENTS PROTECTION APPARATUS AND METHOD

(75) Inventors: John William Huffman, Meridan, ID (US); David M. Payne, Star, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/425,099

(22) Filed: Apr. 28, 2003

(65) Prior Publication Data

US 2004/0213599 A1 Oct. 28, 2004

(51) Int. Cl.[7] ..... G03G 15/08
(52) U.S. Cl. ..... 399/121; 399/112
(58) Field of Search ..... 399/110–113, 121, 399/298, 299, 302; 347/115, 138, 152

(56) References Cited

U.S. PATENT DOCUMENTS

| | | | | |
|---|---|---|---|---|
| 4,651,173 A | | 3/1987 | Ozawa et al. | |
| 4,857,943 A | | 8/1989 | Yoshimura et al. | |
| 5,146,345 A | | 9/1992 | Yamashita et al. | |
| 5,156,477 A | | 10/1992 | Hasegawa | |
| 5,444,515 A | * | 8/1995 | Haneda et al. | 399/112 |
| 5,587,769 A | * | 12/1996 | Sawada et al. | 399/113 |
| 5,918,089 A | | 6/1999 | Malinich et al. | |
| 6,120,201 A | | 9/2000 | McKay et al. | |
| 6,125,251 A | | 9/2000 | Shiraishi et al. | |
| 6,453,135 B1 | * | 9/2002 | Sameshima et al. | 399/110 |
| 6,463,231 B2 | | 10/2002 | Numazu et al. | |
| 6,484,003 B2 | | 11/2002 | Tokutake et al. | |
| 6,522,861 B2 | * | 2/2003 | Tokutake et al. | 399/401 |
| 6,647,227 B2 | * | 11/2003 | Yokoi et al. | 399/111 |

FOREIGN PATENT DOCUMENTS

JP 2002072618 A * 3/2002 ..... G03G/15/01

* cited by examiner

*Primary Examiner*—Robert Beatty

(57) ABSTRACT

A printer with an imaging components protection architecture includes a main housing and a protective housing that is pivotally coupled to the main housing. The protective housing is formed to receive an intermediate transfer belt (ITB) positioned between the protective housing and a print cartridge that is also positioned within the protective housing.

44 Claims, 4 Drawing Sheets

PRINTER IMAGING COMPONENTS PROTECTION APPARATUS AND METHOD

BACKGROUND OF THE INVENTION

In many electrophotographic processes, an electrostatic latent image is formed on a photosensitive member (photoconductive material) and then a latent image is developed with a toner. After being transferred onto a transfer material such as paper, the toner image is fixed, for example, by heating, pressing, or heating and pressing, or using solvent vapor to produce a copy. Residual toner on the photosensitive member is cleaned as desired by various methods, and then the above steps are repeated.

In printer or copying machines utilizing electrophotography, corona dischargers have been widely used to charge the surface of a photosensitive member (electrostatic image-bearing member) or to transfer a toner image on a photosensitive member. Contact charging or transferring approaches, where a contact charging member contacts or presses against a photosensitive member surface while an external voltage is applied, have also been used.

In contact charging or transferring, by way of example, an electroconductive elastic roller is abutted against an electrostatic image-bearing member and a voltage is applied to uniformly charge the electrostatic image-bearing member, which is then subjected to an exposure and a developing step to produce a toner image thereon. Another electroconductive elastic roller supplied with a voltage is pressed against the electrostatic image-bearing member, and a transfer material is passed therebetween to transfer the toner image on the electrostatic image-bearing member onto the transfer material, followed by a fixing step to produce a copied image.

Surfaces relevant to image development, such as the intermediate transfer belt (ITB), which is often tightly strung across rollers, and the optical photoconductor (OPC) of print cartridges, may be fragile and easily damaged. Even during routine replacement of printer consumables there is a significant likelihood of scratching or otherwise damaging these imaging surfaces. Moreover, the aforementioned imaging surfaces are often sensitive to light, e.g., prolonged exposure to ambient light. Printer architectures may cause these surfaces to become exposed, such as when a housing of the printer is opened up by a user or technician to access a printer component or consumable. Furthermore, many printers are designed to facilitate greater access to printer components and/or consumables resulting in an even greater likelihood of inadvertent damage being caused to imaging surfaces. Thus, a dilemma exists, namely, the desire to retain ease in accessibility to print cartridges while simultaneously providing greater protection to easily damaged image development surfaces and, in particular, to the certain surfaces of the ITB.

BRIEF DESCRIPTION OF THE DRAWINGS

Detailed description of embodiments of the invention will be made with reference to the accompanying drawings.

DETAILED DESCRIPTION

The following is a detailed description for carrying out the invention. This description is not to be taken in a limiting sense, but is made merely for the purpose of illustrating the general principles of the invention.

A printer architecture according to some embodiments of the present invention accommodates the rotation of imaging components away from normal customer interface points (control panel, handles, doors etc.) of the printer. The printer architecture provides for protection of imaging components of the printer and, in particular, to imaging surfaces of the ITB without sacrificing user accessibility to print cartridges.

Figure 1:
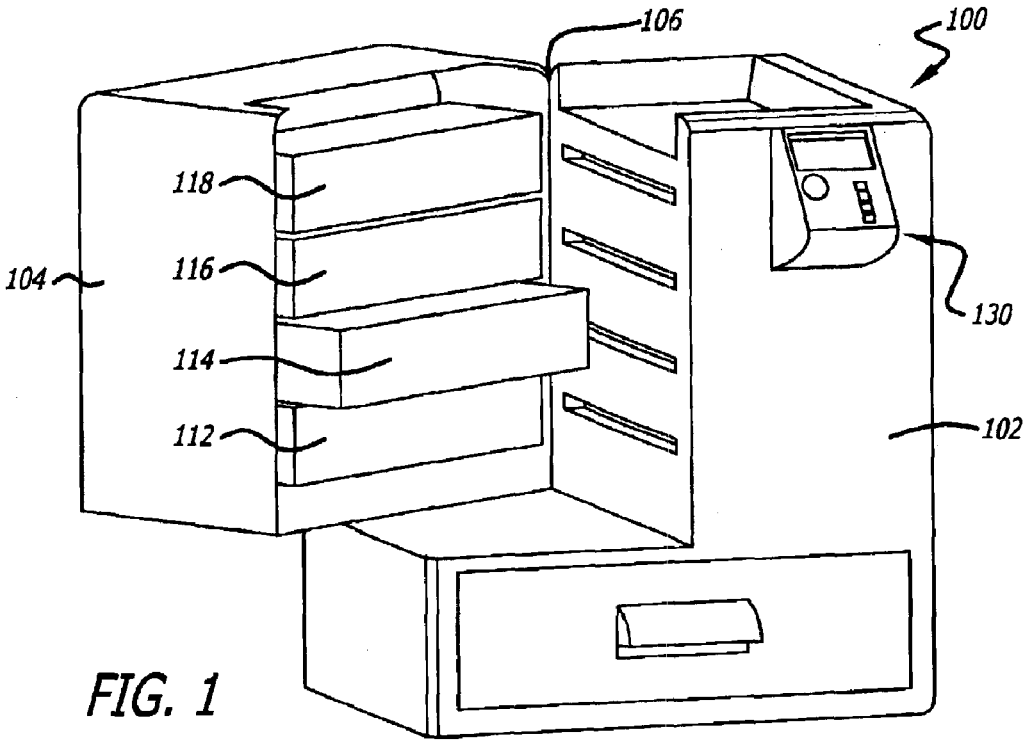
FIG. 1 is a perspective view of a printer configured according to an embodiment of the present invention with a vertically hinged image transfer components protective housing shown in an opened position.
Figure 2:
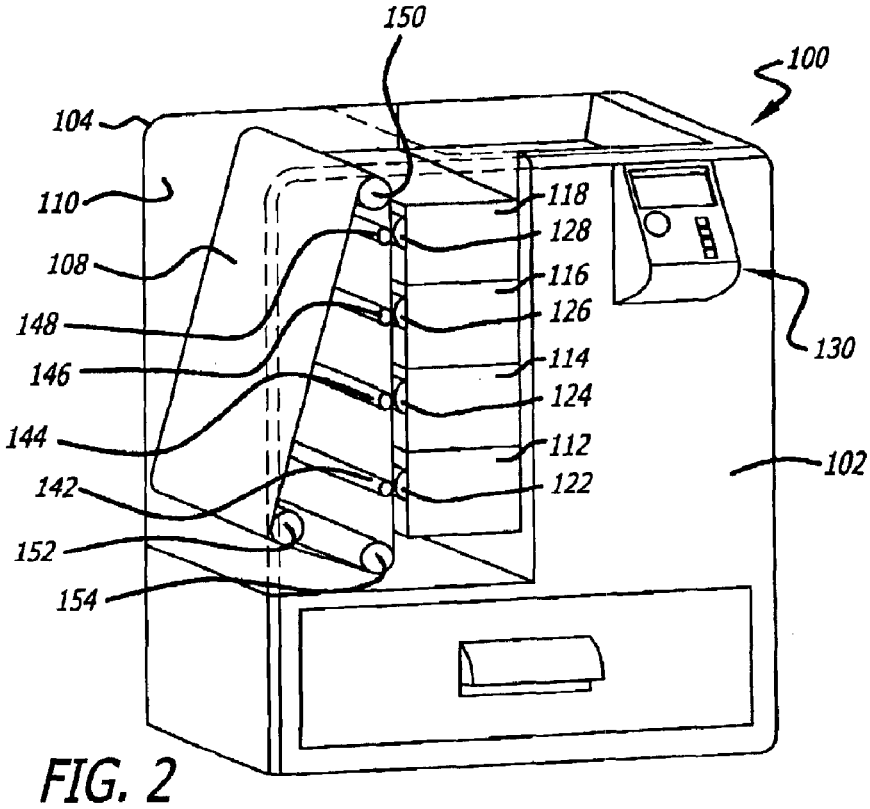
FIG. 2 is a perspective view of the printer of FIG. 1 with the protective housing shown in a closed position.

Referring to FIGS. 1 and 2, a printer 100 with an imaging components protection architecture according to various embodiments of the present invention includes a main housing 102 and an image transfer components protective housing 104 (also referred to as an "imaging components housing" or "image transfer module") that is pivotally coupled to the main housing 102. In this illustrated example, a vertical hinge 106 pivotally couples the protective housing 104 to the main housing 102. The term "vertical" means perpendicular to components (for example, the transfer rollers) within the protective housing 104. It should be appreciated, however, that mechanisms other than hinges can be used for pivotally coupling the protective housing 104 to the main housing 102, or for otherwise repositioning the protective housing 104 relative to the main housing 102.

The protective housing 104 is formed to receive an intermediate transfer belt (ITB) 108 positioned between a back portion 110 of the protective housing 104 and one or more print cartridges that are also positioned within the protective housing 104. In this illustrated example, the protective housing 104 is formed to receive print cartridges 112, 114, 116 and 118 (yellow, magenta, cyan, black, respectively) in a vertical arrangement. It should be appreciated, however, that the protective housing 104 can be configured in various alternative ways to accommodate a different number and/or arrangement of print cartridges (e.g., arrangements that are not "in-line"), as well as print cartridges of different colors or types, arrangements including more than one cartridge of a particular color (e.g., two black ink cartridges), etc.

The protective housing 104 is formed to receive the print cartridges 112, 114, 116 and 118 such that optical photoconductors (OPCs) 122, 124, 126 and 128 of the print cartridges 112, 114, 116 and 118, respectively, face the intermediate transfer belt 108 and the print cartridges 112, 114, 116 and 118 protect the intermediate transfer belt 108 when the protective housing 104 is in an opened position (FIG. 1).

The imaging components are received inside the protective housing 104 and arranged in relation to each other in a manner that protects the critical imaging surfaces of the ITB 108 and the OPCs 122, 124, 126 and 128. To this end, and according to one embodiment, the ITB 108 is first installed and then the print cartridges 112, 114, 116 and 118 are installed with the OPCs 122, 124, 126 and 128 facing the ITB 108 as shown. This arrangement not only protects the critical imaging surfaces of both the ITB 108 and the OPCs 122, 124, 126 and 128, but also provides for easy consumables access when the protective housing 104 is its opened position.

In FIG. 1, the print cartridge 114 is shown partially withdrawn from the protective housing 104. By opening this door (the protective housing 104), a user or technician is provided with easy access to the print cartridges 112, 114, 116 and 118 without the risk of touching the sensitive imaging components such as the ITB 108 and the OPCs 122, 124, 126 and 128. Thus, in this illustrated example, the protective housing 104 is vertically hinged such that non-imaging external surfaces of the print cartridges 112, 114, 116 and 118 face a user or technician when the protective housing 104 is pivoted to an opened position. Moreover, the protective housing 104 is pivotally coupled to the main housing 102 such that imaging surfaces of the ITB 108 and of the print cartridges 112, 114, 116 and 118 are moved away from a front portion 130 of the main housing 102 when the protective housing 104 is moved to an opened position.

Referring to FIG. 2, first transfer (T1) rollers 142, 144, 146 and 148, an ITB drive roller 150, an ITB tensioning roller 152 and a second transfer (T2) counter roller 154 are positioned within and support the ITB 108 as shown. In this illustrated example, the ITB 108 is configured as a triangularly arranged belt; the entire belt is the "imaging surface". In operation, laser beams (not shown) of the printer 100 are swept (e.g., by rotating mirrors) across the OPCs 122, 124, 126 and 128 to form latent images on the rotating surfaces of the OPCs 122, 124, 126 and 128. Toner particles (not shown) of opposite charge stick (i.e., are electrically attracted) to the rotating surfaces. After further rotation, the toner particles come into contact with the ITB 108, which is used to implement an intermediate transfer step between OPC development and final transfer to the media. During this intermediate step, all or some color planes are "layered up" sequentially. In this illustrated example, an image is "layered up" (yellow, magenta, cyan and black, sequentially) on the ITB 108 as it moves upward past the print cartridges 112, 114, 116 and 118. At a transfer nip (not shown) of the printer 100, the toner is attracted to the media (not shown) by contact forces. Thereafter, a fuser (not shown) of the printer 100 fuses the toner to the media.

Embodiments of the present invention may employ a variety of different mechanisms for repositioning imaging components relative to a main housing of a printer, as well as different transfer nip, fuser and/or media path configurations. For example, and referring to FIGS. 3 and 4, a printer 100' is now described. To the extent applicable (e.g., where like parts are identified by like numerals), the description of the printer 100 (FIGS. 1 and 2) is incorporated herein and therefore not repeated. In this illustrated example, the printer 100' includes a horizontal hinge 107 which pivotally couples the protective housing 104 to the main housing 102. The term "horizontal" means parallel to components (for example, the transfer rollers) within the protective housing 104. As with the previously described embodiment, it should be appreciated however that mechanisms other than hinges can be used for pivotally coupling the protective housing 104 to the main housing 102, or for otherwise repositioning the protective housing 104 relative to the main housing 102. In this illustrated example, the printer 100' also includes a stop mechanism 160 (e.g., slider link, followers, etc.) for limiting pivotal movement of the protective housing 104 relative to the main housing 102.

Figure 3:
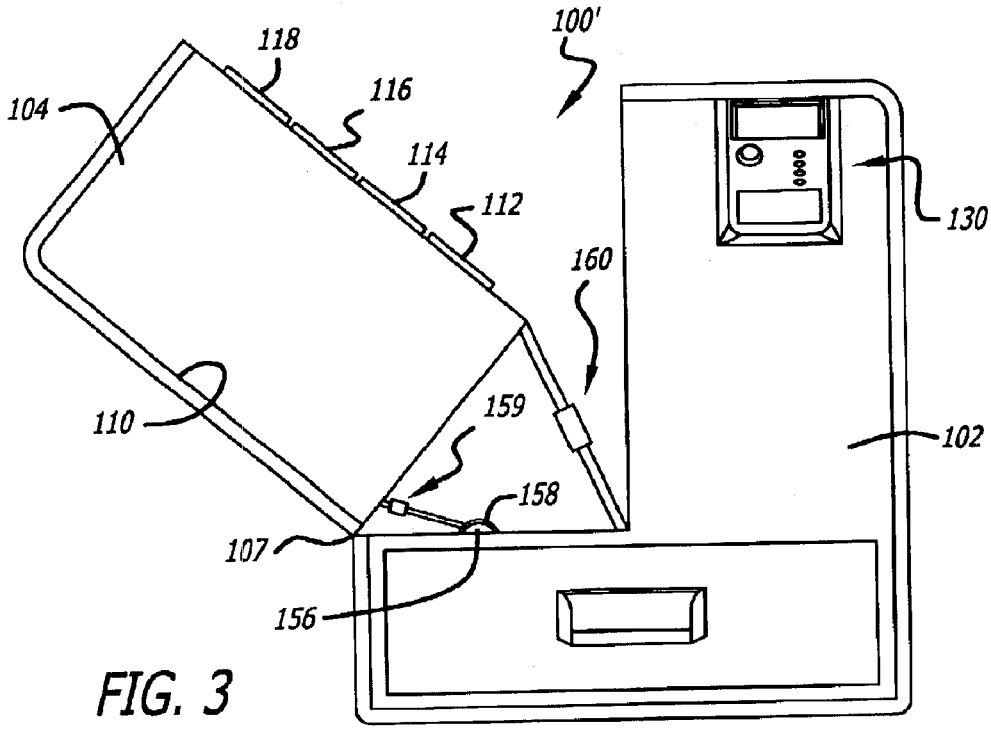
FIG. 3 is a front view of a printer configured according to another embodiment of the present invention with a horizontally hinged image transfer components protective housing shown in an opened position.
Figure 4:
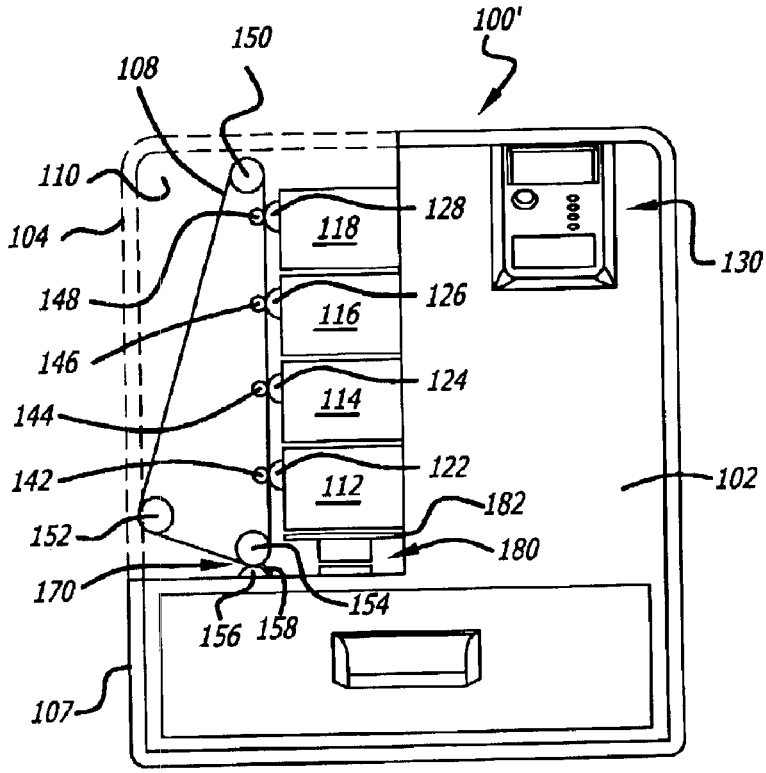
FIG. 4 is a front view of the printer of FIG. 3 with the protective housing shown in a closed position.

In this illustrated example, the printer 100' includes a transfer roller 156 positioned (at least partially) below the protective housing 104, and the protective housing 104 is configured to support a counter roller 154 such that the transfer roller 156 and the counter roller 154 together form a transfer nip 170 when the protective housing 104 is in a closed position (FIG. 4). In this illustrated example, the printer 100' also includes a mechanism for protecting the roller 156 when the protective housing 104 is in an opened position (FIG. 3). By way of example, the protecting mechanism includes a barrier member 158 and mechanical linkage or actuator 159 configured to position the barrier member 158 over the roller 156 when the protective housing 104 is pivoted from the closed position to the opened position. In this illustrated example, the barrier member 158 is a curved plastic shell complementary in shape to the roller 156. Thus, the printer 100' includes a mechanism for protecting one or more of the rollers when the protective housing 104 is in an opened position.

Referring again to FIG. 4, in this illustrated example, the printer 100' includes a fuser 180 positioned below the print cartridges 112, 114, 116 and 118 and a thermal shield 182 between the fuser 180 and the print cartridges 112, 114, 116 and 118. A media path of the printer 100' passes through both the transfer nip 170 and the fuser 180.

Figure 5:
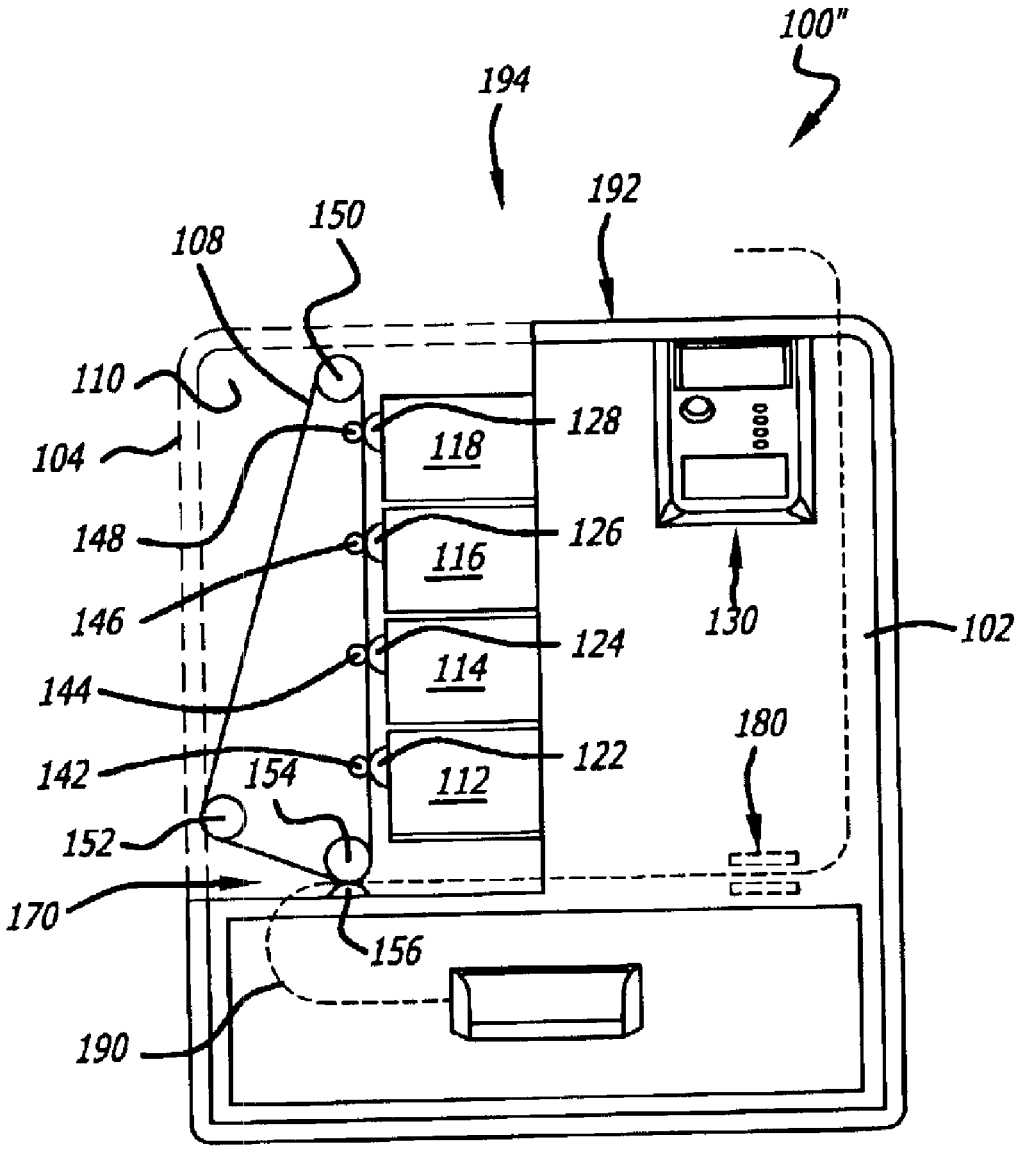
FIG. 5 is a front view of a printer configured according to another embodiment of the present invention with an image transfer components protective housing shown in a closed position, and a media path also shown.

Referring to FIG. 5, a printer 100" is now described. To the extent applicable (e.g., where like parts are identified by like numerals), the description of the printer 100 (FIGS. 1 and 2) and of the printer 100' (FIGS. 3 and 4) is incorporated herein and therefore not repeated. In this illustrated example, the printer 100" has a protective housing 104 that is configured to support both a roller 156 and a counter roller 154 which define a transfer nip 170. In this embodiment (and also in the previously described embodiments), the transfer nip 170 is positioned within the protective housing 104, and the protective housing 104 is configured to support at least one of two rollers which define the transfer nip 170. If sufficient clearance is provided below the roller 156, the protective housing 104 can be mechanically coupled to the main housing 102 employing either of the previously described vertical or horizontal hinging approaches.

Thus, in an embodiment of the present invention, a printer with an imaging components protection architecture includes: a main housing; an imaging components housing configured to receive an ITB into a back portion of the imaging components housing and to receive a vertical arrangement of print cartridges which form a protective barrier for the ITB; and a mechanism for repositioning the imaging components housing relative to the main housing such that the print cartridges are accessible when the imaging components housing has been moved to an opened position. The repositioning mechanism includes, for example, a vertical hinge at a back portion of the imaging components housing or a horizontal hinge at a bottom portion of the imaging components housing.

In the embodiment illustrated in FIG. 5, the printer 100" includes a fuser 180 positioned within the main housing 102, and a media path 190 that begins below the protective housing 104 and advances upward and through the transfer nip 170, past the transfer nip 170 to the fuser 180, and ending at an output tray 192 at a top portion 194 of the main housing 102. Alternatively, the fuser 180 can be positioned below the print cartridges 112, 114, 116 and 118 (e.g., as shown in FIG. 4) and the media path 190 modified as appropriate to accommodate the positioning of the fuser 180. Moreover, it should be appreciated that alternative print cartridge arrangements can be used to create additional space below the print cartridges. This additional space can be used for positioning components (such as the fuser 180) within the protective housing 104 and/or configuring the media path 190 in different ways.

Thus, in an embodiment of the present invention, a method for protecting printer imaging components includes providing a printer with an image transfer module configured to receive a set of components of the printer such that imaging surfaces of the components are protected from contact by a user of the printer until the image transfer module has been opened and at least one of the components removed therefrom. The image transfer module is opened by repositioning the image transfer module relative to a main housing of the printer. For example, the image transfer module is mechanically coupled to the main housing by a vertical or horizontal hinge. In one embodiment, the components include an ITB (e.g., positioned entirely within the image transfer module). In another embodiment, the components include an ITB and one or more print cartridges. In various embodiments, the image transfer module is configured such that the ITB cannot be removed from the image transfer module until the print cartridges have first been removed and/or such that optical photoconductors (OPCs) of the print cartridges face the ITB. It should be appreciated, however, that the principles of the present invention are applicable to any printer component with imaging surfaces, not just to ITBs and OPCs.

Figure 6:
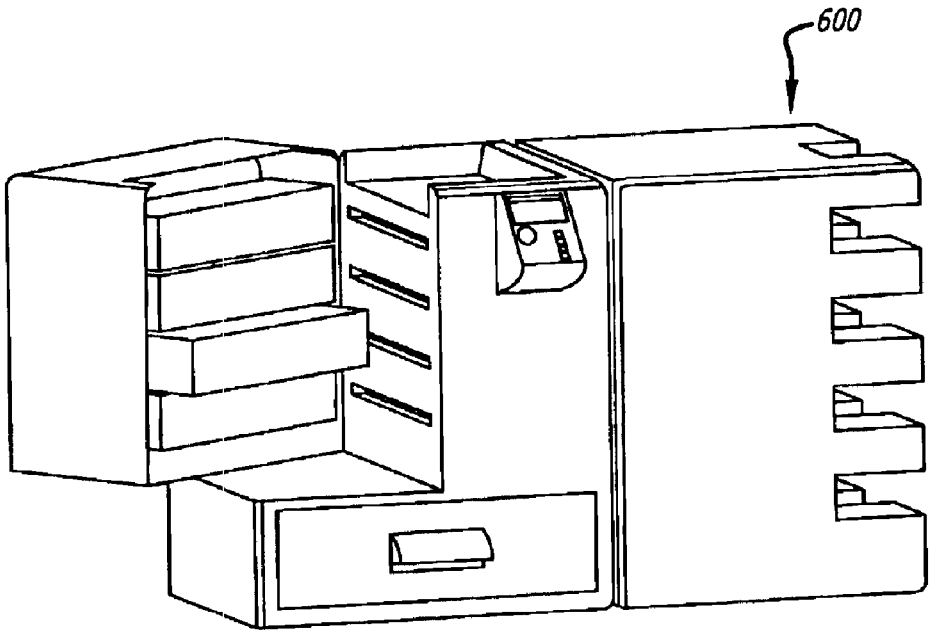
FIG. 6 is a perspective view of a printer configured according to another embodiment of the present invention with a vertically hinged image transfer components protective housing shown in an opened position.
Figure 7:
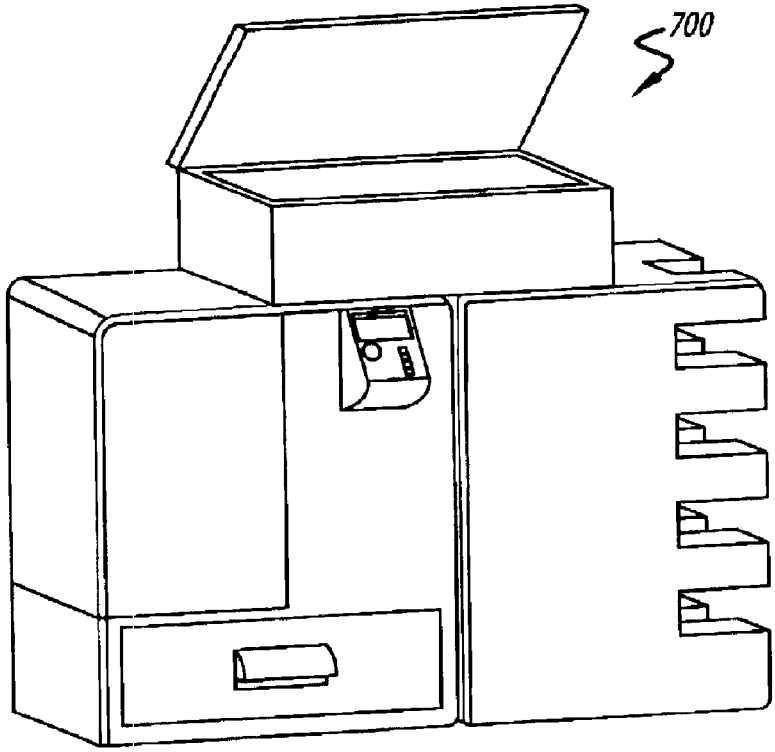
FIG. 7 is a perspective view of the printer of FIG. 6 further including a scanner.

Referring to FIGS. 6 and 7, the architecture of the previously described printers facilitates the integration of additional features with the base printer. In particular, the rotated architecture with its face-up delivery path accommodates optional paper handling devices such as a stapler/stacker 600 (FIG. 6). This type of wide, rather than tall, architecture also accommodates the addition of other "copier features" such as integrated flat bed scanner 700 (FIG. 7). These features can be modular, thereby enhancing the ease of serviceability.

Although the present invention has been described in terms of the example embodiments above, numerous modifications and/or additions to the above-described embodiments would be readily apparent to one skilled in the art. It is intended that the scope of the present invention extend to all such modifications and/or additions.

We claim:

1. A method for protecting printer imaging components, the method comprising the steps of:

pivotally repositioning an image transfer module relative to a main housing of a printer;

installing an intermediate transfer belt (ITB) inside the image transfer module; and installing a print cartridge inside the image transfer module after installing the ITB;

wherein the step of pivotally repositioning includes rotating the image transfer module about a hinge that is perpendicular to a transfer roller within the image transfer module.

2. A printer with an imaging components protection architecture, the printer comprising:

a main housing; and a protective housing that is pivotally coupled to the main housing, the protective housing being formed to receive an intermediate transfer belt (ITB) positioned between the protective housing and a print cartridge that is also positioned within the protective housing;

wherein an optical photoconductor (OPC) of the print cartridge faces the ITB and is not exposed when the protective housing is in an opened position.

3. The printer with an imaging components protection architecture of claim 2, wherein the protective housing is configured such that the ITB cannot be removed from the protective housing until the print cartridge has first been removed.

4. The printer with an imaging components protection architecture of claim 2, wherein the protective housing is formed to receive multiple print cartridges.

5. The printer with an imaging components protection architecture of claim 1, wherein the protective housing is pivotally coupled to the main housing such that imaging surfaces of the ITB are moved away from a front portion of the main housing when the protective housing is moved to an opened position.

6. The printer with an imaging components protection architecture of claim 1, wherein the protective housing is pivotally coupled to the main housing such that an imaging surface of the print cartridge is moved away from a front portion of the main housing when the protective housing is moved to an opened position.

7. The printer with an imaging components protection architecture of claim 1, wherein the protective housing is pivotally coupled to the main housing about a hinge that is perpendicular to a transfer roller within the protective housing.

8. The printer with an imaging components protection architecture of claim 1, wherein the protective housing is pivotally coupled to the main housing about a hinge that is parallel to a transfer roller within the protective housing.

9. The printer with an imaging components protection architecture of claim 5, wherein the printer further includes a stop mechanism for limiting pivotal movement of the protective housing relative to the main housing.

10. The printer with an imaging components protection architecture of claim 1, wherein the protective housing is configured to support at least one of two rollers which define a transfer nip.

11. The printer with an imaging components protection architecture of claim 10, wherein the printer further includes a mechanism for protecting one or more of the rollers when the protective housing is in an opened position.

12. The printer with an imaging components protection architecture of claim 10, wherein the printer includes a media path that begins below the protective housing and advances upward and through the transfer nip.

13. The printer with an imaging components protection architecture of claim 12, wherein the printer includes a fuser positioned within the main housing, and the media path advances past the transfer nip to the fuser.

14. The printer with an imaging components protection architecture of claim 12, wherein the printer includes a fuser positioned below the print cartridges, and the media path advances past the transfer nip to the fuser.

15. The printer with an imaging components protection architecture of claim 14, wherein the printer includes a thermal shield between the fuser and the print cartridges.

16. The printer with an imaging components protection architecture of claim 12, wherein the printer includes an output tray at a top portion of the main housing, and the media path ends at the output tray.

17. The printer with an imaging components protection architecture of claim 2, wherein the protective housing is configured to support both a roller and a counter roller which define a transfer nip.

18. The printer with an imaging components protection architecture of claim 2, wherein the printer includes a roller positioned below the protective housing and the protective housing is configured to support a counter roller such that the roller and counter roller together form a transfer nip when the protective housing is in a closed position.

19. The printer with an imaging components protection architecture of claim 18, wherein the printer further includes a mechanism for protecting the roller when the protective housing is in an opened position.

20. The printer with an imaging components protection architecture of claim 19, wherein the protecting mechanism includes a barrier member and mechanical linkage configured to position the barrier member over the roller when the protective housing is pivoted from the closed position to the opened position.

21. The printer with an imaging components protection architecture of claim 20, wherein the barrier member is a curved plastic shell complementary in shape to the roller.

22. The printer with an imaging components protection architecture of claim 2, wherein the printer further includes a scanner.

23. The printer with an imaging components protection architecture of claim 2, wherein the printer further includes an integrated flat bed scanner.

24. The printer with an imaging components protection architecture of claim 2, wherein the printer further includes one or more paper handling devices.

25. The printer with an imaging components protection architecture of claim 24, wherein the one or more paper handling devices include a stapler.

26. The printer with an imaging components protection architecture of claim 2, wherein the main housing includes a control panel.

27. A printer with an imaging components protection architecture, the printer comprising:

a main housing;

an imaging components housing configured to receive an intermediate transfer belt (ITB) into a back portion of the imaging components housing and to receive a vertical arrangement of print cartridges which form a protective barrier for the ITB; and means for repositioning the imaging components housing relative to the main housing such that the print cartridges are accessible when the imaging components housing has been moved to an opened position, the means for repositioning including a hinge at a back portion of the imaging components housing.

28. The printer with an imaging components protection architecture of claim 27, wherein the means for repositioning includes a hinge at a bottom portion of the imaging components housing.

29. The printer with an imaging components protection architecture of claim 27, wherein the printer includes a transfer nip that is positioned within the imaging components housing.

30. The printer with an imaging components protection architecture of claim 27, wherein the printer includes a transfer nip that is formed by a roller positioned below the imaging components housing and by a counter roller positioned within the imaging components housing.

31. The printer with an imaging components protection architecture of claim 30, wherein the printer includes cover member and an actuator configured to position the cover member over the roller when the imaging components housing is in an opened position.

32. The printer with an imaging components protection architecture of claim 27, wherein the main housing includes a control panel.

33. A printer with an imaging components protection architecture, the printer comprising:

a main housing; and a protective housing that is pivotally coupled to the main housing, the protective housing being formed to receive an intermediate transfer belt (ITB) positioned between the protective housing and a print cartridge that is also positioned within the protective housing, the protective housing being configured such that the ITB cannot be removed from the protective housing until the print cartridge has first been removed.

34. A printer with an imaging components protection architecture, the printer comprising:

a main housing; and a protective housing that is pivotally coupled to the main housing, the protective housing being fanned to receive an intermediate transfer belt (ITB) positioned between the protective housing and a print cartridge that is also positioned within the protective housing, the protective housing being formed to receive multiple print cartridges.

35. A printer with an imaging components protection architecture, the printer comprising:

a main housing; and a protective housing that is pivotally coupled to the main housing, the protective housing being formed to receive an intermediate transfer belt (ITB) positioned between the protective housing and a print cartridge that is also positioned within the protective housing, the protective housing being pivotally coupled to the main housing about a hinge that is perpendicular to a transfer roller within the protective housing.

36. A printer with an imaging components protection architecture, the printer comprising:

a main housing;

a protective housing that is pivotally coupled to the main housing, the protective housing being formed to receive an intermediate transfer belt (ITB) positioned between the protective housing and a print cartridge that is also positioned within the protective housing, the protective housing being configured to support at least one of two rollers which define a transfer nip; and a mechanism for protecting one or more of the rollers when the protective housing is in an opened position.

37. A printer with an imaging components protection architecture, the printer comprising:

a main housing;

a protective housing that is pivotally coupled to the main housing, the protective housing being formed to receive an intermediate transfer belt (ITB) positioned between the protective housing and a print cartridge that is also positioned within the protective housing, the protective housing being configured to support at least one of two rollers which define a transfer nip;

a fuser positioned below the print cartridges; and a media path that begins below the protective housing and advances upward and through the transfer nip past the transfer nip to the fuser.

38. The printer with an imaging components protection architecture of claim 37, wherein the printer includes a thermal shield between the fuser and the print cartridges.

39. A printer with an imaging components protection architecture, the printer comprising:

a main housing; and a protective housing that is pivotally coupled to the main housing, the protective housing being formed to receive an intermediate transfer belt (ITB) positioned between the protective housing and a print cartridge that is also positioned within the protective housing, the protective housing being configured to support both a roller and a counter roller which define a transfer nip.

40. A printer with an imaging components protection architecture, the printer comprising:

a main housing; and a protective housing that is pivotally coupled to the main housing, the protective housing being formed to receive an intermediate transfer belt (ITB) positioned between the protective housing and a print cartridge that is also positioned within the protective housing;

a roller positioned below the protective housing, the protective housing being configured to support a counter roller such that the roller and counter roller together form a transfer nip when the protective housing is in a closed position; and a mechanism for protecting the roller when the protective housing is in an opened position.

41. The printer with an imaging components protection architecture of claim 40, wherein the protecting mechanism includes a barrier member and mechanical linkage configured to position the barrier member over the roller when the protective housing is pivoted from the closed position to the opened position.

42. The printer with an imaging components protection architecture of claim 41, wherein the barrier member is a curved plastic shell complementary in shape to the roller.

43. A printer with an imaging components protection architecture, the printer comprising:

a main housing;

an imaging components housing configured to receive an intermediate transfer belt (ITB) into a back portion of the imaging components housing and to receive a vertical arrangement of print cartridges which form a protective barrier for the ITB; and means for repositioning the imaging components housing relative to the main housing such that the print cartridges are accessible when the imaging components housing has been moved to an opened position, the means for repositioning including a hinge at a bottom portion of the imaging components housing.

44. A printer with an imaging components protection architecture, the printer comprising:

a main housing;

an imaging components housing configured to receive an intermediate transfer belt (ITB) into a back portion of the imaging components housing and to receive a vertical arrangement of print cartridges which form a protective barrier for the ITB;

means for repositioning the imaging components housing relative to the main housing such that the print cartridges are accessible when the imaging components housing has been moved to an opened position;

a transfer nip that is formed by a roller positioned below the imaging components housing and by a counter roller positioned within the imaging components housing and a cover member and an actuator configured to position the cover member over the roller when the imaging components housing is in an opened position.

* * * * *